US007455200B2

(12) United States Patent
Gehl et al.

(10) Patent No.: US 7,455,200 B2
(45) Date of Patent: Nov. 25, 2008

(54) VALVE FOR DISPENSING FLOWABLE PRODUCT

(75) Inventors: John P. Gehl, Nashotah, WI (US); Jon L. Ward, West Bend, WI (US); Charles A. Rademacher, Pewaukee, WI (US)

(73) Assignee: Gehl's Guernsey Farms, Inc., Germantown, WI (US)

( * ) Notice: Subject to any disclaimer, the term of this patent is extended or adjusted under 35 U.S.C. 154(b) by 464 days.

(21) Appl. No.: 10/847,041

(22) Filed: May 17, 2004

(65) Prior Publication Data

US 2005/0252937 A1 Nov. 17, 2005

(51) Int. Cl.
*B67D 3/00* (2006.01)

(52) U.S. Cl. ..... 222/518; 222/514; 251/149.6

(58) Field of Classification Search ..... 222/513, 222/514, 518, 523, 105; 251/149.6; 141/358, 141/360–362

See application file for complete search history.

(56) References Cited

U.S. PATENT DOCUMENTS

| | | | | |
|---|---|---|---|---|
| 1,859,126 | A * | 5/1932 | Boeuf | 222/505 |
| 1,912,304 | A * | 5/1933 | Phillips | 222/513 |
| 2,713,988 | A * | 7/1955 | Kitterman | 251/322 |
| 3,173,579 | A * | 3/1965 | Curie et al. | 222/105 |
| 6,056,157 | A | 5/2000 | Gehl et al. | |
| 6,223,944 | B1 | 5/2001 | Gehl et al. | |
| 2003/0066978 | A1 * | 4/2003 | Enerson | 251/86 |

* cited by examiner

*Primary Examiner*—J. Casimer Jacyna
(74) *Attorney, Agent, or Firm*—Michael Best & Friedrich LLP

(57) ABSTRACT

The present invention provides a valve configured to dispense a flowable product. The valve includes an inner valve portion having a chamber to allow an accumulation therein of the flowable product, an end wall surface, and an annular surface spaced from the end wall surface. The valve also includes an outer valve portion having a chamber receiving therein at least part of the inner valve portion. The outer valve portion further includes an end wall surface engageable with the end wall surface of the inner valve portion, and an annular surface spaced from the end wall surface and engageable with the annular surface of the inner valve portion. The respective end wall surfaces of the inner valve portion and the outer valve portion are engageable substantially simultaneously with engagement of the respective annular surfaces of the inner valve portion and the outer valve portion.

20 Claims, 6 Drawing Sheets

VALVE FOR DISPENSING FLOWABLE PRODUCT

FIELD OF THE INVENTION

This invention relates generally to valves, and more particularly to valves for dispensing flowable products.

BACKGROUND OF THE INVENTION

It is common practice to dispense cheese sauce, ketchup, mustard, and other flowable food products from a package (e.g., a flexible bag or other similar container) using a pump-like dispensing device. In order to prevent bacterial growth in low acid food products, such as cheese sauce, those products should be maintained at or above an elevated temperature (e.g., 140° F.) after the package is opened.

One type of dispensing device widely used for low acid products has a water jacket which surrounds a large part of the package, and water in the water jacket is heated to the required temperature of the food product. A dispensing valve is typically coupled to the package to selectively dispense the flowable food product from the package. Such a dispensing valve is intended to be reused, and therefore should be cleaned after being removed from an empty package. Since the valve is intended to be reused, it is typically manufactured from a food-grade engineered resin capable of withstanding many heating and cooling cycles without substantially degrading due to the acidity of the food product. However, such a food-grade engineered resin is expensive, and the design of conventional valves incorporates multiple O-rings and additional components that increase the cost of the valves.

SUMMARY OF THE INVENTION

The present invention provides, in one aspect, a valve adapted to dispense a flowable product. The valve includes an inner valve portion having a chamber to allow an accumulation therein of the flowable product, an end wall surface, and an annular surface spaced from the end wall surface. The valve also includes an outer valve portion having a chamber receiving therein at least part of the inner valve portion. The outer valve portion further includes an end wall surface engageable with the end wall surface of the inner valve portion, and an annular surface spaced from the end wall surface and engageable with the annular surface of the inner valve portion. The respective end wall-surfaces of the inner valve portion and the outer valve portion are engageable substantially simultaneously with engagement of the respective annular surfaces of the inner valve portion and the outer valve portion.

The invention also provides a valve configured to dispense a flowable product. The valve includes an inner valve portion, an outer valve portion configured to receive at least a portion of the inner valve portion, a button coupled to the inner valve portion, and a resilient member retained directly between a surface of the outer valve portion and a surface of the button to bias the inner valve portion to a first position with respect to the outer valve portion.

The present invention provides, in another aspect, a method of assembling a valve configured to dispense a flowable product. The method includes providing an inner valve portion having a projection, providing an outer valve portion having a chamber with an aperture, inserting the inner valve portion into the chamber of the outer valve portion such that the projection extends through the aperture, positioning a compression spring over the projection, providing a button engageable with the projection, and engaging the button with the projection to capture the compression spring directly between the outer valve portion and the button.

The present invention provides, in yet another aspect, a method of operating a valve adapted to dispense a flowable product. The method includes substantially simultaneously disengaging respective annular surfaces of the inner valve portion and the outer valve portion and respective end wall surfaces of the inner valve portion and the outer valve portion, aligning a first aperture in the inner valve portion with a second aperture in the outer valve portion to dispense the flowable product, and substantially simultaneously engaging the respective annular surfaces and the respective end wall surfaces.

The present invention provides, in a further aspect, a method of replacing an existing package containing a flowable product. The package is housed within a dispensing device and has coupled thereto an existing valve for dispensing the flowable product from the package. The method includes providing a replacement package of flowable product and a replacement valve configured to dispense the flowable product from the replacement package, removing the existing package and the existing valve from within the dispensing device, disposing of the existing package and the existing valve, coupling the replacement valve with the replacement package, and inserting the coupled replacement package and replacement valve into the dispensing device.

The present invention provides, in still another aspect, a refill kit including at least two packages of flowable product, and a corresponding at least two valves to dispense the flowable product from the respective packages. The valves are initially disconnected from the respective packages. Each valve is configured to couple to only one package for a single use, and each valve is disposable with the respective package without uncoupling the valve from the package.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
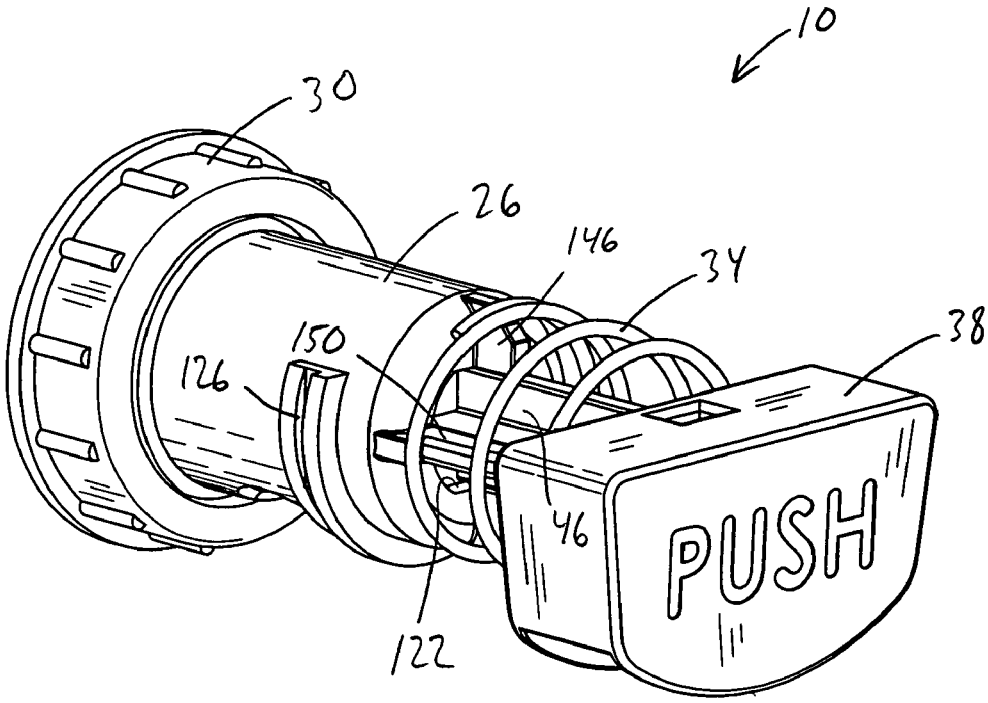
FIG. 1 is a front perspective view of a valve of the present invention.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items.

DETAILED DESCRIPTION

Figure 6:
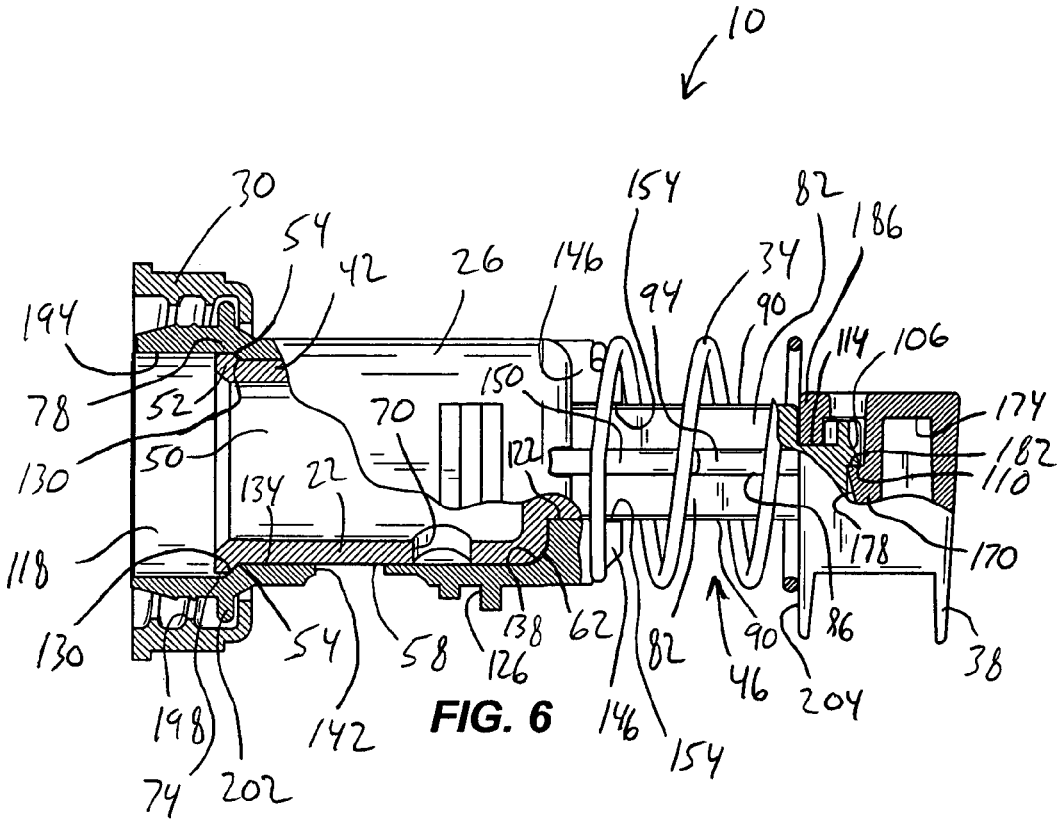
FIG. 6 is a partial cutaway left side view of the valve of FIG. 1, illustrating the valve in a closed position.
Figure 7:
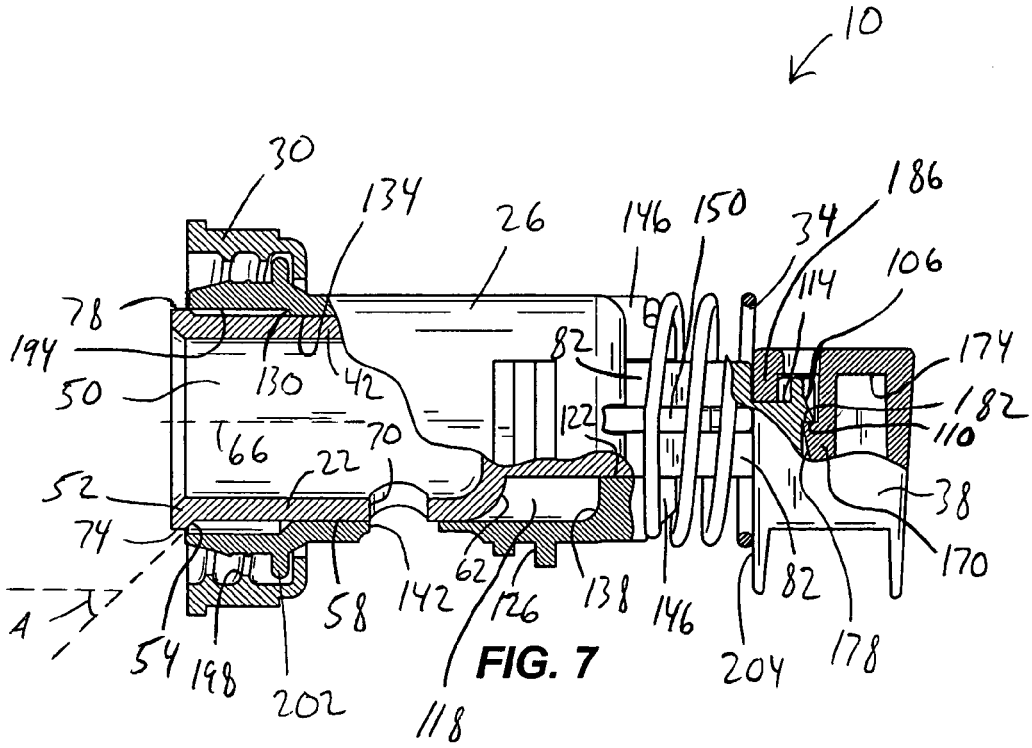
FIG. 7 is a partial cutaway left side view of the valve of FIG. 1, illustrating the valve in an open position.
Figure 8:
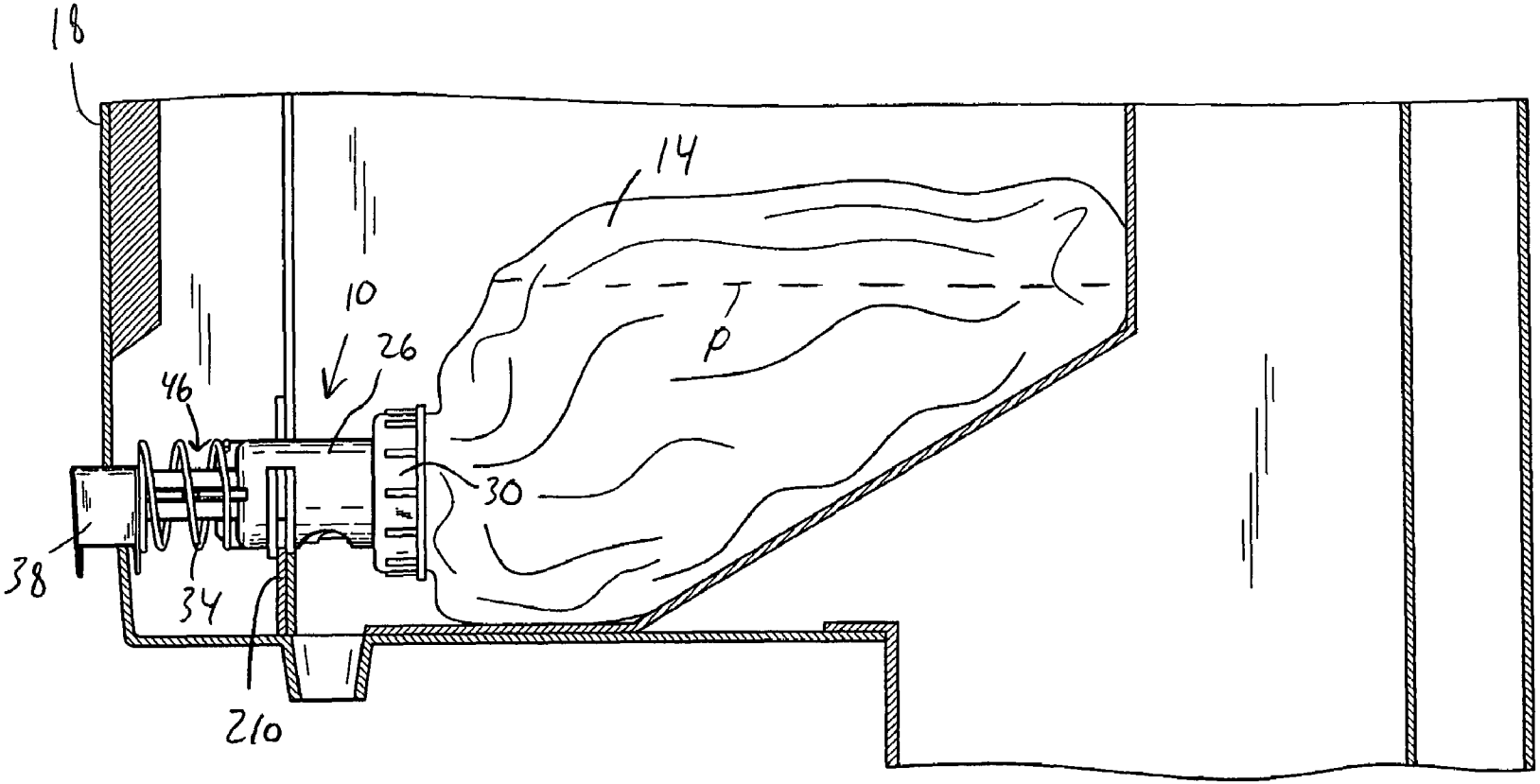
FIG. 8 is a partial cross-sectional view of a dispensing device incorporating a package of flowable product and the valve of FIG. 1 coupled to the package.

FIGS. 1-7 illustrate a valve 10 of the present invention. The valve 10 is adapted to couple to a package 14 (see FIG. 8) containing flowable product to selectively dispense the flowable product. In the illustrated embodiment, the package 14 is flexible (e.g., a bag) and may contain flowable food product (e.g., cheese sauce, ketchup, mustard, mayonnaise, and other condiments), however, the valve 10 may also be utilized to dispense other kinds of flowable products from other kinds of packages. The valve 10 is configured to be coupled to the package 14, and the coupled valve 10 and package 14 are configured to be housed in a dispensing device 18 (only a portion of which is shown in FIG. 8). Reference is made to U.S. Pat. Nos. 6,223,944 and 6,056,157, each of which is incorporated herein by reference, for additional discussion relating to the package 14 of flowable food product and the dispensing device 18.

Figure 5:
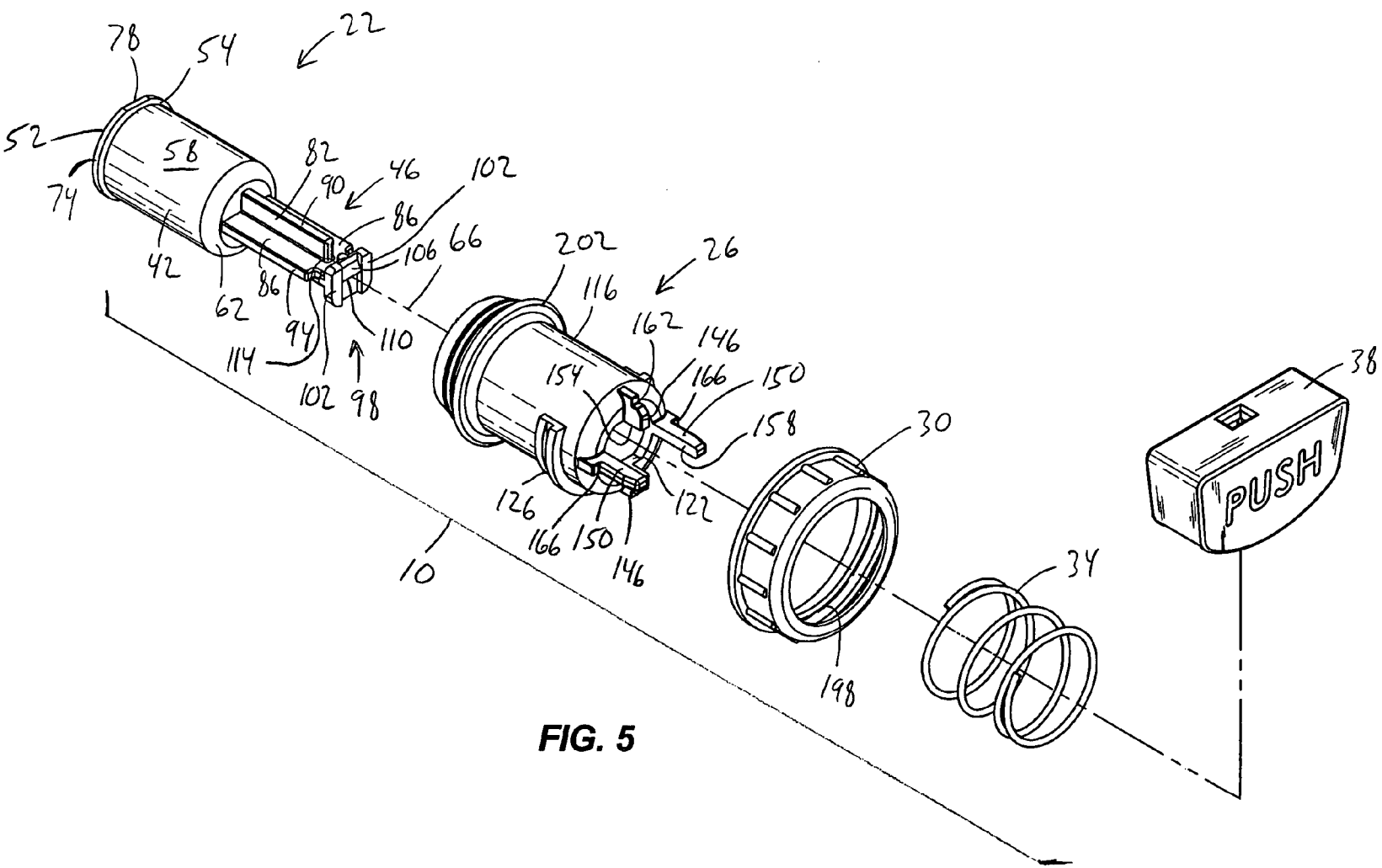
FIG. 5 is an exploded front perspective view of the valve of FIG. 1.

With reference to FIG. 5, the valve 10 includes an inner valve portion 22, an outer valve portion 26, a threaded member 30, a resilient member or compression spring 34, and a button 38. The inner valve portion 22 generally includes a substantially cylindrical body 42 and a projection 46 extending from the body 42. As shown in FIGS. 6 and 7, the body 42 of the inner valve portion 22 defines a chamber 50 in which flowable food product may accumulate when the valve 10 is coupled to a package 14 containing flowable food product.

The body 42 of the inner valve portion 22 includes a shoulder 52 extending from an exterior surface 58 of the body 42 adjacent the open end of the chamber 50. The shoulder 52 includes an annular surface 54 extending around the circumference of the body 42 and radially outwardly from the exterior surface 58 at an angle A between about 15 degrees and about 75 degrees with respect to a longitudinal axis 66 passing through the body 42. In the illustrated construction, the annular surface 54 extends radially outwardly from the exterior surface 58 at an angle A of about forty-five degrees with respect to the longitudinal axis 66.

The body 42 of the inner valve portion 22 also includes an end wall surface 62 on an opposite side of the body 42 from the shoulder 52. The body 42 of the inner valve portion 22 further includes an aperture 70 positioned between the annular surface 54 and the shoulder 62. The purpose of the annular surface 54, the end wall surface 62, and the aperture 70 will be described in detail below.

With reference to FIG. 5, at least part of the inner valve portion 22 defines a non-circular cross-sectional portion. More particularly, the shoulder 52 includes a lip surface 74 adjacent the annular surface 54 that defines the non-circular cross-sectional portion. Like the annular surface 54, the lip surface 74 extends around the circumference of the body 42. However, a flat 78 is formed on a portion of the lip surface 74 opposite the aperture 70 in the body 42. Alternatively, the flat 78 may be formed on the lip surface 74 in any angular position with respect to the aperture 70. The purpose of the flat 78 is described below in more detail.

With continued reference to FIG. 5, the inner valve portion 22 also includes the projection 46 extending from the body 42 of the inner valve portion 22 along the longitudinal axis 66. Generally, the projection 46 defines a plus-shaped (i.e., "+" shaped) or t-shaped cross-section in a plane perpendicular to the longitudinal axis 66. In other words, the projection 46 defines ribs intersecting at the longitudinal axis 66 and that are generally perpendicular to one another. In the illustrated construction, a rib 82 is angularly aligned with the aperture 70 in the body 42 of the inner valve portion 22, and a rib 86 is angularly offset from the first rib 82 by about ninety degrees.

Also, in the illustrated construction, the first rib 82 includes respective opposite surfaces 90, and the second rib 86 includes respective opposite surfaces 94. In addition, the second rib 86 extends radially outwardly further than the first rib 82. These aspects of the projection 46 are discussed in more detail below.

The projection 46 further includes a mounting portion 98 (see FIG. 5) at the end of the projection 46 opposite the body 42. The mounting portion 98 includes opposite rails 102, and a ramp surface 106 and a raised lip 110 positioned between the rails 102. The mounting portion 98, in combination with a recess 114 formed in the rib 82, engage the button 38 to secure the button 38 to the inner valve portion 22, as will be described in greater detail below.

With continued reference to FIG. 5, the outer valve portion 26 receives therein at least a portion of the inner valve portion 22. More particularly, as shown in FIGS. 6 and 7, the outer valve portion 26 includes a generally cylindrical body portion 116 that defines a chamber 118 for receiving the body 42 of the inner valve portion 22. The outer valve portion 26 also includes an aperture 122 (see FIG. 5) aligned with the longitudinal axis 66 through which the projection 46 extends when the body 42 of the inner valve portion 22 is received in the chamber 118 of the outer valve portion 26. The outer valve portion 26 further includes an alignment groove 126 formed on the body portion 116, which is discussed in greater detail below.

With reference to FIGS. 6 and 7, the outer valve portion 26 includes an annular surface 130 and an interior surface 134 that define a portion of the chamber 118. The annular surface 130 extends around the circumference of the chamber 118 and is disposed at substantially the same angle with respect to the longitudinal axis 66 as the annular surface 54 of the inner valve portion 22. In the illustrated construction, the annular surface 130 is disposed at an angle of about forty-five degrees with respect to the longitudinal axis 66. The outer valve portion 26 also includes an end wall surface 138 defining a portion of the chamber 118 adjacent the aperture 122. The outer valve portion 26 further includes an aperture 142 formed in the body portion 116 and positioned between the annular surface 130 and the end wall surface 138.

Figure 2:
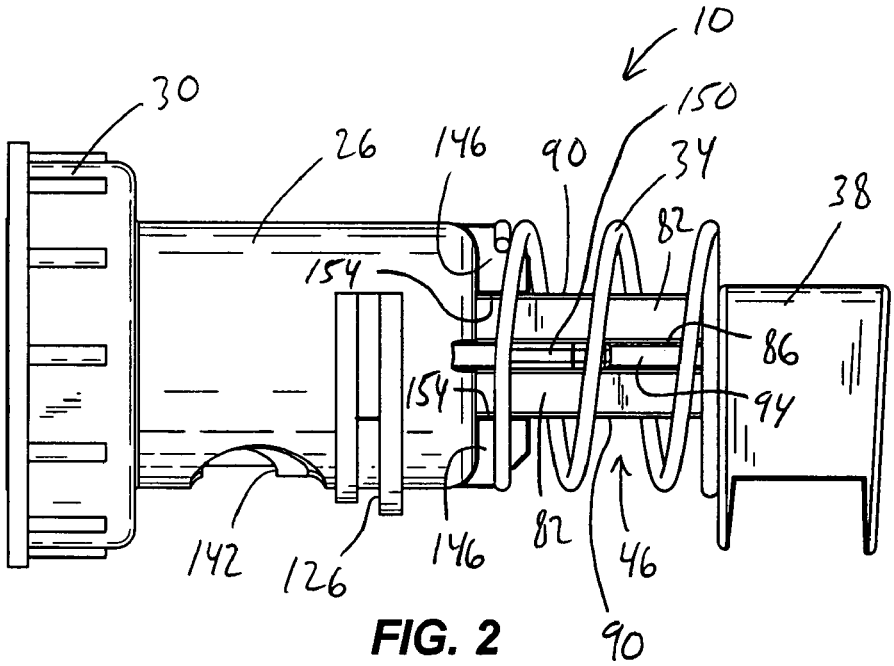
FIG. 2 is a left side view of the valve of FIG. 1.
Figure 3:
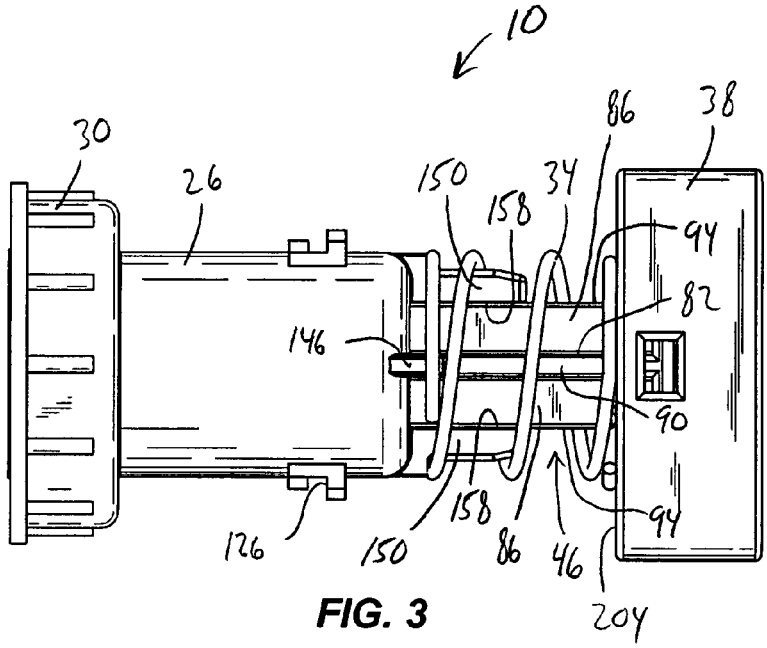
FIG. 3 is a top view of the valve of FIG. 1.

With reference to FIG. 5, the outer valve portion 26 includes a first pair of tabs 146 extending substantially parallel to the longitudinal axis 66 and a second pair of tabs 150, also extending substantially parallel to the longitudinal axis 66. The first and second pairs of tabs 146, 150 are angularly spaced (e.g., ninety degrees in the illustrated embodiment) about the longitudinal axis 66 and about the aperture 122 in the outer valve portion 26. The first pair of tabs 146 defines respective opposing guide surfaces 154 and the second pair of tabs 150 defines respective opposing guide surfaces 158. As shown in FIGS. 2 and 3, the first pair of tabs 146 extends radially inwardly further than the second pair of tabs 150. In other words, the respective guide surfaces 154 of the first pair of tabs 146 are more closely spaced to the longitudinal axis 66 than the respective guide surfaces 158 of the second pair of tabs 150.

With continued reference to FIGS. 2 and 3, the second pair of tabs 150 extends further from the body portion 116 in the direction of the longitudinal axis 66 than the first pair of tabs 146. In addition, with reference to FIG. 5, both of the first and second pairs of tabs 146, 150 define respective pairs of spring perches 162, 166 for receiving the compression spring 34 (see FIGS. 2 and 3). These aspects of the first and second pairs of tabs 146, 150 are discussed below in more detail.

Figure 4:
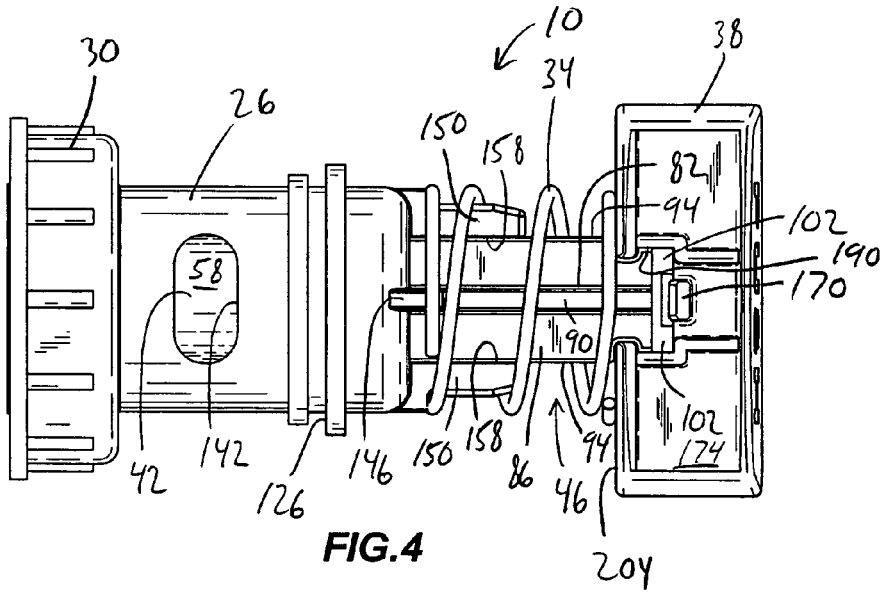
FIG. 4 is a bottom view of the valve of FIG. 1.

With reference to FIGS. 6 and 7, a partial cutaway of the button 38 exposes the locking structure of the button 38. More particularly, the locking structure of the button 38 includes a resilient tab 170 extending downwardly from an upper surface 174 of the button 38. The resilient tab 170 includes a ramp surface 178 and a raised lip 182. As shown in FIG. 4, the resilient tab 170 is positioned in the interior of the button 38 and is accessible by a user from the bottom side of the button 38 to deflect the resilient tab 170, as will be described in more detail below. Further, the button 38 includes a downwardly-extending lip 186 also extending downwardly from the upper surface 174 and spaced from the resilient tab 170. As shown in FIG. 4, a slot 190 is defined between the resilient tab 170 and the downwardly-extending lip 186. These aspects of the resilient tab 170 and the button 38 are discussed in more detail below.

With reference to FIG. 5, to assemble the valve 10, the inner valve portion 22 is inserted into the outer valve portion 26. More particularly, the body 42 of the inner valve portion 22 is inserted into the chamber 118 of the outer valve portion 26 such that the projection 46 extends through the aperture 122 in the outer valve portion 26. The inner valve portion 22 is oriented such that the aperture 70 in the inner valve portion 22 is angularly aligned with the aperture 142 in the outer valve portion 26. To facilitate achieving such orientation between the inner valve portion 22 and the outer valve portion 26, the flat 78 on the lip surface 74 of the inner valve portion 22 is aligned with a corresponding flat 194 (see FIGS. 6 and 7) formed on a mating surface of the outer valve portion 26 prior to insertion. Alternatively, the body 42 of the inner valve portion 22 may include a longitudinally-extending groove or rib (not shown) to be engaged by a mating rib or groove (also not shown) formed on the interior surface 134 of the chamber 118 of the outer valve portion 26. Of course, other known constructions can be used to facilitate aligning the inner and outer valve portions 22, 26.

With reference to FIGS. 2 and 3, as the body 42 of the inner valve portion 22 is received within the chamber 118 of the outer valve portion 26 and the projection 46 passes through the aperture 122, the respective guide surfaces 154 of the first pair of tabs 146 slidably engage the respective opposite surfaces 90 of the first rib 82, and the respective guide surfaces 158 of the second pair of tabs 150 slidably engage the respective opposite surfaces 94 of the second rib 86. This engagement also helps orient the inner valve portion 22 with respect to the outer valve portion 26. It should be noted that in other embodiments, there may not be sliding engagement between the guide surfaces 154 and the respective opposite surfaces 90, and the guide surfaces 158 and the respective opposite surfaces 94.

With reference to FIG. 5, to continue assembly of the valve 10, the threaded member 30 may be positioned on or slipped over the assembled inner valve portion 22 and outer valve portion 26. Alternatively, the threaded member 30 may be positioned on the outer valve portion 26 before inserting the inner valve portion 22 into the outer valve portion 26. The threaded member 30 is configured with threads 198 sized to engage mating threads on the package 14 to couple the valve 10 to the package 14. The threaded member 30 is positioned in abutment with a radially-extending lip 202 on the outer valve portion 26 to seal the valve 10 to the package 14.

After assembling the inner and outer valve portions 22, 26, the compression spring 34 is positioned on or slipped over the projection 46 such that one end of the compression spring 34 is supported by the pairs of spring perches 162, 166 on the respective first and second pairs of tabs 146, 150. Alternatively, the compression spring 34 can positioned to engage the spring perches 162, 166 before the inner valve portion 22 is inserted into the outer valve portion 26. It should also be noted that the threaded member 30 can be positioned on or slipped over the outer valve portion 26 after positioning the compression spring 34 on the spring perches 162, 166.

The button 38 is then engaged with the projection 46 to capture the compression spring 34 between the spring perches 162, 166 and an inner end wall 204 of the button 38. More particularly, the downwardly-extending lip 186 of the button 38 is inserted into (downwardly with respect to FIGS. 6 and 7) the recess 114 in the rib 82 to orient the button 38 with respect to the projection 46. The rails 102 of the mounting portion 98 engage the slot 190 in the button 38 and align the raised lip 110 on the mounting portion 98 with the raised lip 182 on the resilient tab 170. As the button 38 is pressed downwardly further onto the mounting portion 98, the respective ramp surfaces 106, 178 of the mounting portion 98 and the resilient tab 170 engage and cause the resilient tab 170 to deflect (to the right with respect to FIGS. 6 and 7) until the respective raised lips 110, 182 on the mounting portion 98 and the resilient tab 170 pass by one another and resiliently interlock to secure the button 38 to the projection 46.

To disassemble the valve 10, a user may access the interior of the button 38 to manually deflect the resilient tab 170 (to the right with respect to FIGS. 6 and 7) to disengage the respective raised lips 110, 182 of the mounting portion 98 and the resilient tab 170, and then lift the button 38 upwardly to disengage the rails 102 from the slot 190, thereby disengaging the button 38 from the mounting portion 98. The remaining components may then be disassembled by reversing the procedure described above.

With reference to FIGS. 6 and 7, after coupling the valve 10 with the package 14, the valve 10 may be selectively actuated by a user between a first or closed position (see FIG. 6), in which the respective annular surfaces 54, 130 of the inner valve portion 22 and the outer valve portion 26 engage and the respective end wall surfaces 62, 138 of the inner valve portion 22 and the outer valve portion 26 engage to substantially seal the inner valve portion 22 with respect to the outer valve portion 26, and a second or open position (see FIG. 7), in which the respective annular surfaces 54, 130 are disengaged and the respective end wall surfaces 62, 138 are disengaged.

With reference to FIG. 6, when the respective annular surfaces 54, 130 and the respective end wall surfaces 62, 138 are engaged, the flowable food product is substantially prevented from leaking past the interfaces between the respective annular surfaces 54, 130 and the respective end wall surfaces 62, 138. The spacing between the annular surface 54 and the end wall surface 62 of the inner valve portion 22 correlates with the spacing between the annular surface 130 and the end wall surface 138 of the outer valve portion 26 so that the respective annular surfaces 54, 130 engage and disengage substantially simultaneously with the respective end wall surfaces 62, 138. In addition, a small clearance of about 0.002 inches or less exists between the exterior surface 58 of the body 42 of the inner valve portion 22 and the interior surface 134 of the outer valve portion 26. Such a small clearance substantially prevents leakage of the flowable food product between the inner valve portion 22 and the outer valve portion 26.

In the open position shown in FIG. 7, the respective apertures 70, 142 of the inner valve portion 22 and the outer valve portion 26 are aligned to permit dispensing of the flowable food product accumulated in the chamber 50 of the inner valve portion 22. In other words, when the inner valve portion 22 is moved to the second position, the accumulated flowable food product in the chamber 50 is allowed to pass through the respective apertures 70, 142 in the inner valve portion 22 and the outer valve portion 26. Since the clearance between the exterior surface 58 of the body 42 of the inner valve portion 22 and the interior surface 134 defining the chamber 118 of the outer valve portion 26 is small, as described above, the flowable food product is substantially prevented from leaking between the inner valve portion 22 and the outer valve portion 26.

With continued reference to FIG. 7, the second pair of tabs 150 on the outer valve portion 26 may also act as stops to limit the movement of the inner valve portion 22 with respect to the outer valve portion 26. More particularly, the user can depress the button 38 until the inner end wall 204 of the button 38 abuts the second pair of tabs 150 to stop the inner valve portion 22 in the second position, in which the respective apertures 70, 142 of the inner valve portion 22 and the outer valve portion 26 are aligned to dispense the flowable food product. To close the valve 10, the user releases the button 38, such that the bias of the compression spring 34 returns the inner valve portion 22 back to the first or closed position illustrated in FIG. 6.

As a result of this construction having the respective annular surfaces 54, 130, the respective end wall surfaces 62, 138, and the small clearance between the exterior surface 58 of the inner valve portion 22 and the interior surface 134 of the outer valve portion 26 to seal the inner valve portion 22 to the outer valve portion 26, O-rings and/or other sealing members that are utilized in conventional flowable-product dispensing valves are not required in the valve 10 of the present invention. By eliminating O-rings, the cost of the valve 10 may be decreased by decreasing the part count of the valve 10 and by simplifying the manufacturing and/or assembly process of the valve 10.

All of the components of the valve 10 (except for the compression spring 34) may be made from a food-grade plastic compatible with the flowable food product. Such a food-grade plastic may include, among other suitable plastics, a polycarbonate resin available from the Bayer Corporation under the brand name Makrolon 2458. Such a polycarbonate resin is less expensive than more exotic and durable food-grade engineered resins, which are typically used in conventional flowable-product dispensing valves that are designed to be cleaned and re-used each time a package 14 requires replacement.

The valve 10 of the present invention is intended for a single use with a single package 14. In other words, the valve 10 is intended to be disposed of with the package 14 rather than being removed and cleaned for repeated use. The design and manufacture of the valve 10 incorporates one or more aspects (e.g., eliminating conventional O-rings, utilizing less expensive materials, etc.) to make the single-use valve 10 economical. An economical single-use valve 10 means that the time and effort previously required of a user for repeated cleaning of the valve at product changeover can be eliminated.

With reference to FIG. 8, an existing package 14 containing a flowable food product P is shown housed within the dispensing device 18. An existing valve 10 is shown coupled to the existing package 14. To replace the existing package 14, a replacement valve 10 is coupled to a replacement package 14 of flowable food product. The existing package 14 is removed from the dispensing device 18 with the existing valve 10 coupled to the existing package 14. Since the valve 10 is intended for a single use, the existing valve 10 is disposed of with the existing package 14 without removing the existing valve 10 from the existing package 14. After the existing package 14 with the existing valve 10 is removed, the replacement package 14 with the replacement valve 10 is positioned in the dispensing device 18. As shown in FIG. 8, a wall 210 of the dispensing device 18 engages the alignment groove 126 on the outer valve portion 26 to secure the valve 10 in the dispensing device 18.

Figure 9:
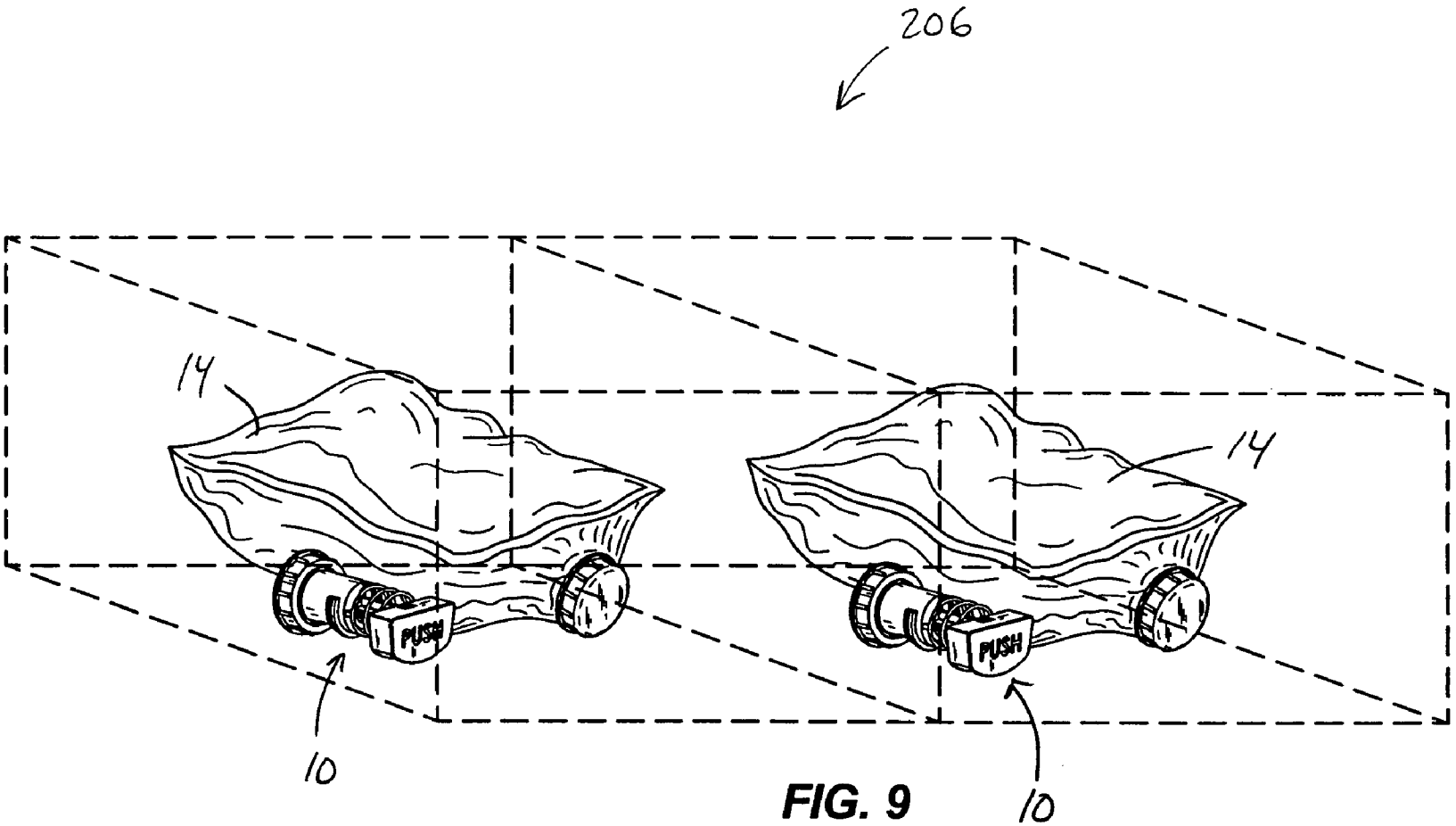
FIG. 9 is a schematic view illustrating a refill kit for the dispensing device of FIG. 8, the refill kit including replacement packages and replacement valves.

With reference to FIG. 9, the valve 10 of the present invention may be incorporated in a refill kit 206 including at least two replacement packages 14 of flowable food product P and at least two replacement valves 10 to dispense the flowable food product P from the respective replacement packages 14. The replacement valves 10 are initially disconnected from the respective replacement packages 14. As previously discussed, each replacement valve 10 is configured and intended to couple to only one replacement package 14 for a single use. Also, each replacement valve 10 is disposable with its corresponding replacement package 14 without uncoupling the replacement valve 10 from the replacement package 14.

Various features and aspects of the invention are set forth in the following claims.

The invention claimed is:

1. A valve configured to dispense a flowable product, the valve comprising:

an inner valve portion including a substantially cylindrical body defining a longitudinal axis;

a chamber to allow an accumulation therein of the flowable product;

an end wall surface; and an annular surface spaced from the end wall surface, the annular surface extending radially outwardly from the body at an angle non-parallel to the longitudinal axis; and a one-piece outer valve portion including a chamber receiving therein at least part of the inner valve portion;

an end wall surface defining a distal end of the chamber of the outer valve portion, the end wall surface of the outer valve portion engageable with the end wall surface of the inner valve portion; and an annular surface spaced from the end wall surface of the outer valve portion and engageable with the annular surface of the inner valve portion;

wherein the respective end wall surfaces of the inner valve portion and the outer valve portion are engageable substantially simultaneously with engagement of the respective annular surfaces of the inner valve portion and the outer valve portion.

2. The valve of claim 1, wherein the inner valve portion is movable with respect to the outer valve portion between a first position, in which the respective annular surfaces of the inner valve portion and the outer valve portion engage and the respective end wall surfaces of the inner valve portion and the outer valve portion engage to substantially seal the inner valve portion with respect to the outer valve portion, and a second position, in which the respective annular surfaces of the inner valve portion and the outer valve portion disengage and the respective end wall surfaces of the inner valve portion and the outer valve portion disengage.

3. The valve of claim 2, further comprising:

a first aperture in the inner valve portion positioned between the annular surface and the end wall surface of the inner valve portion; and a second aperture in the outer valve portion positioned between the annular surface and the end wall surface of the outer valve portion, the first and second apertures being at least partially aligned during movement of the inner valve portion with respect to the outer valve portion to dispense the flowable product accumulated in the chamber of the inner valve portion.

4. The valve of claim 1, wherein there are no O-rings between the inner and outer valve portions.

5. The valve of claim 1, further comprising a resilient member biasing the respective annular surfaces of the inner valve portion and the outer valve portion into engagement and biasing the respective end wall surfaces of the inner valve portion and the outer valve portion into engagement.

6. The valve of claim 1, wherein the chamber of the outer valve portion is substantially cylindrical, wherein the substantially cylindrical body of the inner valve portion is received by the substantially cylindrical chamber of the outer valve portion, and wherein a clearance of about 0.002 inches or less exists between an exterior surface of the body of the inner valve portion and an interior surface of the chamber of the outer valve portion.

7. The valve of claim 1, wherein at least part of the inner valve portion defines a non-circular cross-sectional portion, and at least part of the outer valve portion defines a non-circular cross-sectional portion engageable with the non-circular cross-sectional portion of the inner valve portion, and wherein the respective non-circular cross-sectional portions determine a unique orientation of the inner valve portion with respect to the outer valve portion.

8. The valve of claim 1, wherein the annular surface of the inner valve portion extends radially outwardly from the body at an angle between about 15 degrees and about 75 degrees with respect to the longitudinal axis of the body.

9. The valve of claim 1, wherein at least one of the inner valve portion and the outer valve portion is made from a food-grade plastic to dispense flowable food product.

10. The valve of claim 1, further comprising an alignment groove formed on the outer valve portion, wherein the alignment groove is engageable with a wall of a dispensing device to secure the valve to the dispensing device.

11. The valve of claim 1, wherein at least one of the inner valve portion and the outer valve portion is made from a food-grade plastic to dispense flowable food product, and wherein the valve is one of two identical valves packaged together with at least two packages of flowable product, the valves being initially disconnected from the respective packages, each valve being configured to couple to only one package for a single use, and each valve being disposable with the respective package without uncoupling the valve from the package.

12. A valve configured to dispense a flowable product, the valve comprising:

an inner valve portion including a substantially cylindrical body defining a longitudinal axis;

a chamber to allow an accumulation therein of the flowable product;

an end wall surface; and an annular surface spaced from the end wall surface, the annular surface extending radially outwardly from the body at an angle non-parallel to the longitudinal axis; and an outer valve portion including a chamber receiving therein at least part of the inner valve portion;

an end wall surface defining a distal end of the chamber of the outer valve portion, the end wall surface of the outer valve portion engageable with the end wall surface of the inner valve portion; and an annular surface spaced from the end wall surface of the outer valve portion and engageable with the annular surface of the inner valve portion;

wherein the respective end wall surfaces of the inner valve portion and the outer valve portion are engageable substantially simultaneously with engagement of the respective annular surfaces of the inner valve portion and the outer valve portion;

wherein the inner valve portion includes a projection extending from the body, wherein the outer valve portion includes an aperture, and wherein the projection extends through the aperture in the outer valve portion when the body of the inner valve portion is received within the chamber of the outer valve portion.

13. The valve of claim 12, further comprising:

a first pair of opposed tabs extending from the outer valve portion; and a second pair of opposed tabs extending from the outer valve portion, wherein the first pair of opposed tabs slidably engages first respective opposite surfaces on the projection, and wherein the second pair of opposed tabs slidably engages second respective opposite surfaces on the projection.

14. The valve of claim 13, wherein the first pair of opposed tabs extends radially inwardly further than the second pair of opposed tabs.

15. The valve of claim 12, further comprising:

at least one tab extending from the outer valve portion; and a button coupled to the projection, wherein the button is engageable with the at least one tab to limit movement of the inner valve portion with respect to the outer valve portion.

16. The valve of claim 12, further comprising:

a button coupled to the projection; and a resilient member surrounding the projection and retained directly between the outer valve portion and the button, the resilient member biasing the respective annular surfaces of the inner valve portion and the outer valve portion into engagement and biasing the respective end wall surfaces of the inner valve portion and the outer valve portion into engagement.

17. The valve of claim 12, further comprising a button including a resilient tab extending therefrom, the resilient tab including a raised lip, wherein the raised lip of the resilient tab is engageable with a raised lip on the projection to lock the button to the projection.

18. The valve of claim 17, wherein the resilient tab is positioned in an interior space of the button and is accessible by a user to deflect the resilient tab to unlock the button from the projection.

19. The valve of claim 12, further comprising a button including a downwardly-extending lip therefrom, wherein the lip is engageable with a recess in the projection to orient the button with respect to the projection.

20. The valve of claim 12, wherein at least one of the inner valve portion and the outer valve portion is made from a food-grade plastic to dispense flowable food product, and wherein the valve is one of two identical valves packaged together with at least two packages of flowable product, the valves being initially disconnected from the respective packages, each valve being configured to couple to only one package for a single use, and each valve being disposable with the respective package without uncoupling the valve from the package.

* * * * *